US012084873B2

(12) United States Patent
Reiter et al.

(10) Patent No.: US 12,084,873 B2
(45) Date of Patent: Sep. 10, 2024

(54) VIBRATING SCREED

(71) Applicant: MILWAUKEE ELECTRIC TOOL CORPORATION, Brookfield, WI (US)

(72) Inventors: Joseph C. Reiter, Milwaukee, WI (US); Daryl S. Richards, Sussex, WI (US); Caleb Hendryx, Sussex, WI (US)

(73) Assignee: MILWAUKEE ELECTRIC TOOL CORPORATION, Brookfield, WI (US)

( * ) Notice: Subject to any disclaimer, the term of this patent is extended or adjusted under 35 U.S.C. 154(b) by 556 days.

(21) Appl. No.: 17/399,658

(22) Filed: Aug. 11, 2021

(65) Prior Publication Data

US 2022/0049507 A1 Feb. 17, 2022

Related U.S. Application Data

(60) Provisional application No. 63/166,617, filed on Mar. 26, 2021, provisional application No. 63/064,089, filed on Aug. 11, 2020.

(51) Int. Cl.

| | |
|---|---|
| ***E01C 19/40*** | (2006.01) |
| ***E04F 21/24*** | (2006.01) |
| ***E04G 21/06*** | (2006.01) |

(52) U.S. Cl.

CPC ..... *E04F 21/242* (2013.01); *E01C 19/40* (2013.01); *E04G 21/066* (2013.01)

(58) Field of Classification Search

CPC ..... E04F 21/242; E04G 21/066; E01C 19/40
USPC ..... 404/84.05, 114, 118
See application file for complete search history.

(56) References Cited

U.S. PATENT DOCUMENTS

| | | | |
|---|---|---|---|
| 2,008,296 | A | 7/1935 | Soldan |
| 2,178,881 | A | 11/1939 | Roeth |
| 2,314,985 | A | 3/1943 | Corwill |
| 2,400,341 | A | 5/1946 | Day et al. |
| 2,411,317 | A | 11/1946 | Day et al. |

(Continued)

FOREIGN PATENT DOCUMENTS

| | | | |
|---|---|---|---|
| CN | 206635617 | U | 11/2017 |
| CN | 108797279 | A | 11/2018 |

(Continued)

OTHER PUBLICATIONS

MBW, Inc., "ScreeDemon," Operator's Safety and Service Manual, © Dec. 2003 (21 pages).

(Continued)

*Primary Examiner* — Raymond W Addie
(74) *Attorney, Agent, or Firm* — Michael Best & Friedrich LLP

(57) ABSTRACT

A vibrating screed comprising a screed member, a motor, and an exciter assembly configured to vibrate the screed member in response to receiving torque from the motor via a driveshaft. The exciter assembly includes a first eccentric mass fixed on the driveshaft and a second eccentric mass axially and rotationally moveable along the driveshaft between a first position and a second position in which the second eccentric mass is axially closer to the first eccentric mass than in the first position. The vibrating screed further comprises a mode selection member to switch the exciter assembly between a first, low vibration mode, in which the second eccentric mass is in the first position, and a second, high vibration mode, in which the second eccentric mass is in the second position.

10 Claims, 11 Drawing Sheets

(56) References Cited

U.S. PATENT DOCUMENTS

| | | | | |
|---|---|---|---|---|
| 2,449,851 | A | 9/1948 | Corwill | |
| 2,501,158 | A | 3/1950 | Chilcott | |
| 2,693,136 | A | 11/1954 | Barnes | |
| 2,808,238 | A | 10/1957 | Spitler | |
| 3,410,528 | A | 11/1968 | Clark et al. | |
| 3,522,740 | A | 8/1970 | Hynes et al. | |
| 3,792,617 | A | 2/1974 | Strasser et al. | |
| 4,343,568 | A | 8/1982 | Kaltenegger | |
| 4,367,054 | A | 1/1983 | Salani et al. | |
| 4,650,366 | A | 3/1987 | Morrison | |
| 4,701,071 | A | 10/1987 | Morrison | |
| 4,798,494 | A | 1/1989 | Allen | |
| 4,832,525 | A | 5/1989 | Morrison | |
| 4,838,730 | A | 6/1989 | Owens | |
| 4,848,961 | A | 7/1989 | Rouillard | |
| 4,861,188 | A | 8/1989 | Rouillard | |
| 5,190,401 | A | 3/1993 | Wilson | |
| 5,244,305 | A | 9/1993 | Lindley | |
| 5,375,942 | A | 12/1994 | Lindley et al. | |
| 5,540,519 | A | 7/1996 | Weber | |
| D399,400 | S | 10/1998 | Weber | |
| 5,857,803 | A | 1/1999 | Davis et al. | |
| 5,984,571 | A | 11/1999 | Owens | |
| 6,089,787 | A | 7/2000 | Allen et al. | |
| 6,200,065 | B1 | 3/2001 | Eitzen | |
| 6,223,495 | B1 | 5/2001 | Shaw et al. | |
| 6,231,331 | B1 | 5/2001 | Lievers | |
| 6,267,532 | B1 * | 7/2001 | Persson | E01C 19/38 404/133.05 |
| 6,296,467 | B1 | 10/2001 | Rouillard | |
| 6,322,286 | B1 | 11/2001 | Rijkers | |
| 6,374,569 | B1 | 4/2002 | Suckow | |
| 6,695,531 | B1 | 2/2004 | Prescott | |
| 6,705,799 | B2 | 3/2004 | Piccoli | |
| 6,758,631 | B2 | 7/2004 | Frankeny | |
| 6,837,648 | B1 * | 1/2005 | Wadensten | E01C 19/283 404/117 |
| 6,953,304 | B2 | 10/2005 | Quenzi et al. | |
| 6,976,805 | B2 | 12/2005 | Quenzi et al. | |
| 6,981,819 | B1 | 1/2006 | Suckow et al. | |
| 6,988,851 | B2 | 1/2006 | Sina | |
| 7,052,204 | B2 | 5/2006 | Lutz | |
| 7,097,384 | B2 | 8/2006 | Lindley | |
| 7,121,762 | B2 | 10/2006 | Quenzi et al. | |
| 7,153,058 | B2 | 12/2006 | Lindley | |
| 7,156,577 | B1 | 1/2007 | Rozinski | |
| 7,175,365 | B1 | 2/2007 | Breeding | |
| 7,201,537 | B2 | 4/2007 | Sina | |
| 7,204,659 | B2 | 4/2007 | Schmitt et al. | |
| 7,293,938 | B1 | 11/2007 | Suckow et al. | |
| 7,320,558 | B2 | 1/2008 | Quenzi et al. | |
| 7,491,011 | B2 | 2/2009 | Quenzi et al. | |
| 7,540,688 | B1 | 6/2009 | Suckow et al. | |
| 7,544,012 | B2 | 6/2009 | Lura | |
| 7,549,822 | B2 | 6/2009 | Rouillard | |
| 7,572,082 | B2 | 8/2009 | Rouillard | |
| 7,651,296 | B2 | 1/2010 | Lindley | |
| 7,686,538 | B2 | 3/2010 | Lutz et al. | |
| 7,704,012 | B2 | 4/2010 | Lura | |
| 7,909,533 | B2 | 3/2011 | Quenzi et al. | |
| 7,959,374 | B2 | 6/2011 | Lura | |
| 8,104,992 | B2 | 1/2012 | Biodrowski | |
| 8,182,173 | B2 | 5/2012 | Lickel | |
| 8,342,489 | B1 | 1/2013 | Richardson et al. | |
| D685,395 | S | 7/2013 | Sperfslage | |
| 8,608,402 | B2 | 12/2013 | Argento et al. | |
| 9,267,247 | B2 | 2/2016 | Angel | |
| 9,393,708 | B2 | 7/2016 | Babaev | |
| 11,660,781 | B2 | 5/2023 | Jernei et al. | |
| 2002/0102134 | A1 * | 8/2002 | Piccoli | E01C 19/402 404/114 |
| 2006/0018713 | A1 | 1/2006 | Rouillard | |
| 2006/0291958 | A1 | 12/2006 | Argento et al. | |
| 2007/0134064 | A1 | 6/2007 | Lura | |
| 2007/0201302 | A1 | 8/2007 | Lindley | |
| 2010/0129153 | A1 | 5/2010 | Rouillard | |
| 2010/0199774 | A1 * | 8/2010 | Stenzel | E01C 19/38 73/672 |
| 2010/0296869 | A1 | 11/2010 | Catanzarite et al. | |
| 2011/0164923 | A1 | 7/2011 | Quenzi et al. | |
| 2011/0211910 | A1 | 9/2011 | Argento et al. | |
| 2011/0217121 | A1 | 9/2011 | Argento et al. | |
| 2012/0251241 | A1 | 10/2012 | Sperfslage | |
| 2013/0055835 | A1 | 3/2013 | Schmidt et al. | |
| 2017/0175405 | A1 | 6/2017 | Lindley | |
| 2017/0218576 | A1 | 8/2017 | Lindley | |
| 2018/0202175 | A1 | 7/2018 | Lindley | |
| 2018/0236490 | A1 | 8/2018 | Johnsson et al. | |
| 2019/0006980 | A1 | 1/2019 | Sheeks et al. | |
| 2020/0076337 | A1 | 3/2020 | Abbott et al. | |

FOREIGN PATENT DOCUMENTS

| | | | |
|---|---|---|---|
| CN | 108797983 | A | 11/2018 |
| CN | 208762840 | U | 4/2019 |
| CN | 106013809 | B | 9/2019 |
| CN | 111042504 | A | 4/2020 |
| CN | 111206476 | A | 5/2020 |
| CN | 109281458 | B | 6/2020 |
| CN | 111350363 | A | 6/2020 |
| CN | 210684392 | U | 6/2020 |
| CN | 212128759 | U | 12/2020 |
| CN | 113279307 | A | 8/2021 |
| EP | 0540918 | B1 | 9/1995 |
| EP | 1267001 | B1 | 9/2009 |
| EP | 2123844 | A2 | 11/2009 |
| EP | 3536858 | A1 | 9/2019 |
| JP | 2006336424 | A | 12/2006 |
| KR | 200237678 | Y1 | 10/2001 |
| WO | 2008019935 | A1 | 2/2008 |

OTHER PUBLICATIONS

International Search Report and Written Opinion for Application No. PCT/US2021/045539 dated Nov. 22, 2021 (14 pages).
International Search Report and Written Opinion for Application No. PCT/US2022/080383 dated Mar. 24, 2023 (12 pages).

* cited by examiner

VIBRATING SCREED

CROSS-REFERENCE TO RELATED APPLICATIONS

This application claims priority to U.S. Provisional Patent Application No. 63/166,617 filed on Mar. 26, 2021 and U.S. Provisional Patent Application No. 63/064,089 filed on Aug. 11, 2020, the entire contents of both of which are incorporated herein by reference.

FIELD OF THE INVENTION

The present invention relates to screeds for leveling concrete, and more particularly to vibrating screeds.

BACKGROUND OF THE INVENTION

Vibrating screeds include a blade and a vibration mechanism to impart vibration to the blade to facilitate smoothing and leveling a poured viscous material, such as concrete.

SUMMARY OF THE INVENTION

The present invention provides, in one aspect, a vibrating screed comprising a screed member, a motor, and an exciter assembly configured to vibrate the screed member in response to receiving torque from the motor via a driveshaft. The exciter assembly includes a first eccentric mass fixed on the driveshaft and a second eccentric mass axially and rotationally moveable along the driveshaft between a first position and a second position in which the second eccentric mass is axially closer to the first eccentric mass than in the first position. The vibrating screed further comprises a mode selection member to switch the exciter assembly between a first, low vibration mode, in which the second eccentric mass is in the first position, and a second, high vibration mode, in which the second eccentric mass is in the second position.

The present invention provides, in another aspect, a vibrating screed comprising a screed member, a motor, and an exciter assembly configured to vibrate the screed member in response to receiving torque from the motor via a driveshaft. The exciter assembly includes a first eccentric mass fixed on the driveshaft and a second eccentric mass axially and rotationally moveable along driveshaft between a first position and a second position. In the first position, the second eccentric mass is 180 degrees about the drive shaft from the first eccentric mass. In the second position, the second eccentric mass is axially closer to the first eccentric mass than in the first position and is less than 180 degrees about the drive shaft from the first eccentric mass. The vibrating screed further comprises a mode selection member to switch the exciter assembly between a first low vibration mode and a second, high vibration mode. In the first, low vibration mode, the second eccentric mass is in the first position. In the second, high vibration mode, the second eccentric mass is in the second position.

The present invention provides, in another aspect, a vibrating screed comprising a screed member, a motor, and an exciter assembly configured to vibrate the screed member in response to receiving torque from the motor via a driveshaft. The exciter assembly includes a first eccentric mass, a second eccentric mass, and a third eccentric mass. The first eccentric mass is fixed on the driveshaft, the second eccentric mass is axially movable along and rotatable relative to the drive shaft, the second eccentric mass having an eccentric weight portion, and the third eccentric mass is axially movable along and rotatable relative to the drive shaft, the third eccentric mass having an eccentric weight portion. The vibrating screed further comprises a mode selection member to switch the exciter assembly between a first low vibration mode, a second medium vibration mode, and a third high vibration mode. In the first, low vibration mode, the second eccentric mass is mated for rotation with the first eccentric mass on the driveshaft such that the eccentric weight portion of the second eccentric mass is 180 degrees from the first eccentric mass about the driveshaft, and the third eccentric mass is axially spaced from and not rotatable with the first eccentric mass. In the second, medium vibration mode, the second and third eccentric masses are both axially spaced from and not rotatable with the first eccentric mass. In the third, high vibration mode, the third eccentric mass is mated for rotation with the first eccentric mass on the driveshaft such that the eccentric weight portion of the third eccentric mass is rotationally aligned with the first eccentric mass on the driveshaft, and the second eccentric mass is axially spaced from and not rotatable with the first eccentric mass.

The present invention provides, in another aspect, a vibrating screed comprising a screed member, a motor, an exciter assembly configured to vibrate the screed member in response to receiving torque from the motor via a driveshaft, a frame coupled to the screed via a first plurality of vibration dampers configured to attenuate a transfer of vibration from the screed member to the frame, and a housing in which control electronics for the motor are located, the housing coupled to the frame via a second plurality of vibration dampers configured to attenuate a transfer of vibration from the frame to the housing.

The present invention provides, in another aspect, a vibrating screed comprising a screed member, a brushless direct-current motor, a power switching network coupled between a power source and the brushless direct-current motor, and an exciter assembly configured to vibrate the screed member in response to receiving torque from the motor via a driveshaft, and an electric processor. The electric processor is electrically coupled to the motor and the power switching network and is configured to operate the brushless direct-current motor at a selected speed by providing pulse-width modulated signals to the power switching network, the pulse-width modulated signals having a duty ratio, determine a current speed of the brushless direct-current motor, determine whether a difference between the selected speed and the current speed is above a threshold amount, and modify the duty ratio by a predetermined amount when the difference between the selected speed and the current speed is above the threshold amount to continue operating the motor at the selected speed.

BRIEF DESCRIPTION OF THE DRAWINGS

FIG. 11 is a cross-sectional view of the vibrating screed taken along line 11-11 in

FIG. 10.

Before any embodiments of the invention are explained in detail, it is to be understood that the invention is not limited in its application to the details of construction and the arrangement of components set forth in the following description or illustrated in the following drawings. The invention is capable of other embodiments and of being practiced or of being carried out in various ways. Also, it is to be understood that the phraseology and terminology used herein is for the purpose of description and should not be regarded as limiting.

DETAILED DESCRIPTION

Figure 1:
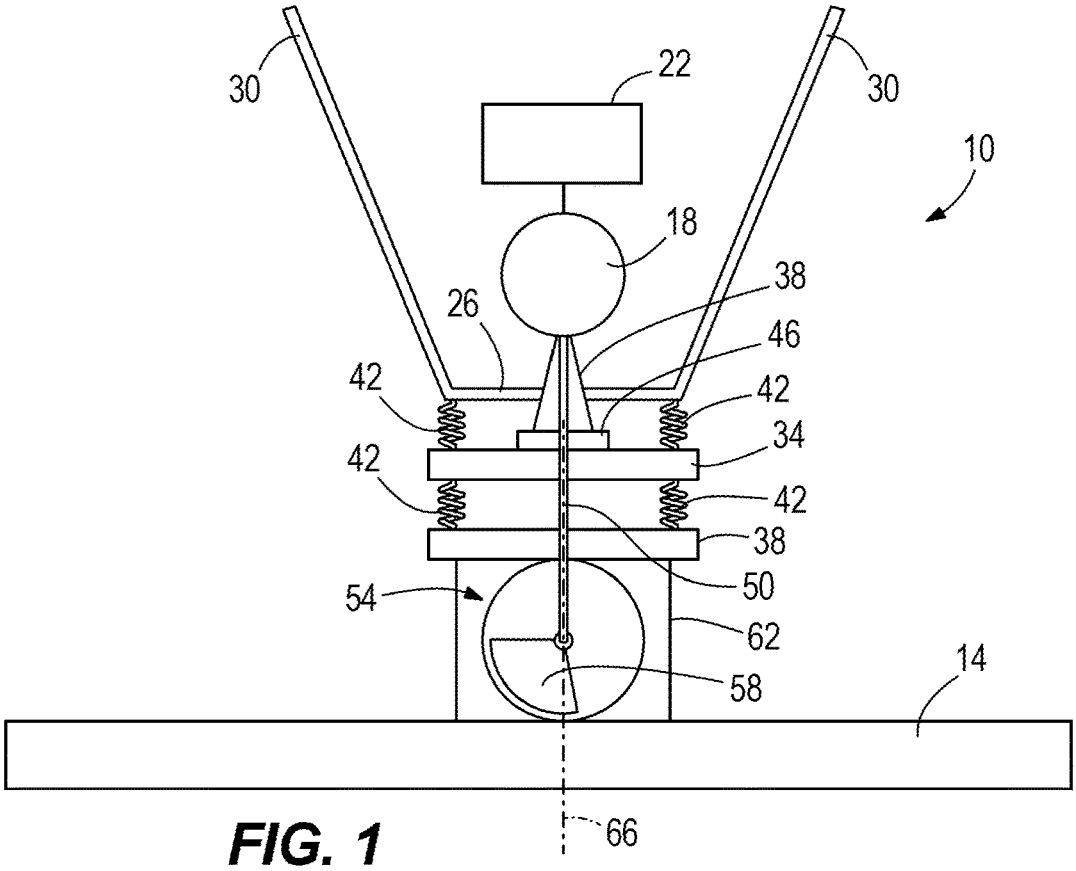
FIG. 1 is a schematic view of a vibrating screed.

As shown in FIG. 1, a vibrating screed 10 includes a screed member 14, such as bar or blade, for smoothing and leveling a viscous material, such as concrete. The vibrating screed 10 also includes an electric motor 18, a battery pack 22 (i.e., a power source) for powering the motor 18, and a frame 26 upon which the motor 18 and battery pack 22 are supported. The frame 26 includes a pair of handles 30, a first platform 34 on which the motor 18 and a drive housing 38 is arranged, and a second platform 38 below which the screed member 14 is arranged. In some constructions, the battery pack 22 and the motor 18 can be configured as an 80 Volt high power battery pack and motor, such as the 80 Volt battery pack and motor disclosed in U.S. patent application Ser. No. 16/025,491 filed on Jul. 2, 2018 (now U.S. Patent Application Publication No. 2019/0006980), the entirety of which is incorporated herein by reference. In such a battery pack 22, the battery cells within the battery pack 22 have a nominal voltage of up to about 80 V. In some embodiments, the battery pack 22 has a weight of up to about 6 lb. In some embodiments, each of the battery cells has a diameter of up to 21 mm and a length of up to about 71 mm. In some embodiments, the battery pack 22 includes up to twenty battery cells. In some embodiments, the battery cells are connected in series. In some embodiments, the battery cells are operable to output a sustained operating discharge current of between about 40 A and about 60 A. In some embodiments, each of the battery cells has a capacity of between about 3.0 Ah and about 5.0 Ah. And, in some embodiments of the motor 18 when used with the 80 Volt battery pack 22, the motor 18 is a high power output motor having a power output of at least about 2760 W and a nominal outer diameter (measured at the stator) of up to about 80 mm. In alternative embodiments, the battery pack 22 may power a motor 18 which has a power output other than (i.e., less than or greater than) 2760 W. In alternative embodiments, instead of an electric motor and a battery pack, a gas engine may be used.

With continued reference to FIG. 1, to attenuate vibration transmitted to the operator, the motor 18, and battery pack 22, vibration dampers 42 are arranged between the first and second platforms 34, 38, as well as the first platform 34 and the handles 30. Another vibration damper 46 is arranged between the drive housing 38 and the first platform 34 and the drive housing 38. A flexible driveshaft 50 transmits torque from the motor 18 to an exciter assembly 54 that is configured to vibrate the screed member 14. The exciter assembly 54 includes an eccentric mass 58 that is coupled for rotation with the driveshaft 50 and arranged in an exciter housing 62 that is coupled to the screed member 14. In response to the motor 18 rotating the driveshaft 50, the eccentric mass 58 rotates about a rotational axis 66 defined by the driveshaft 50, causing a rotating unbalance that transmits vibration through the exciter housing 62 to the screed member 14, thus causing the screed member 14 to vibrate in a direction parallel with the axis 66.

Figure 2:
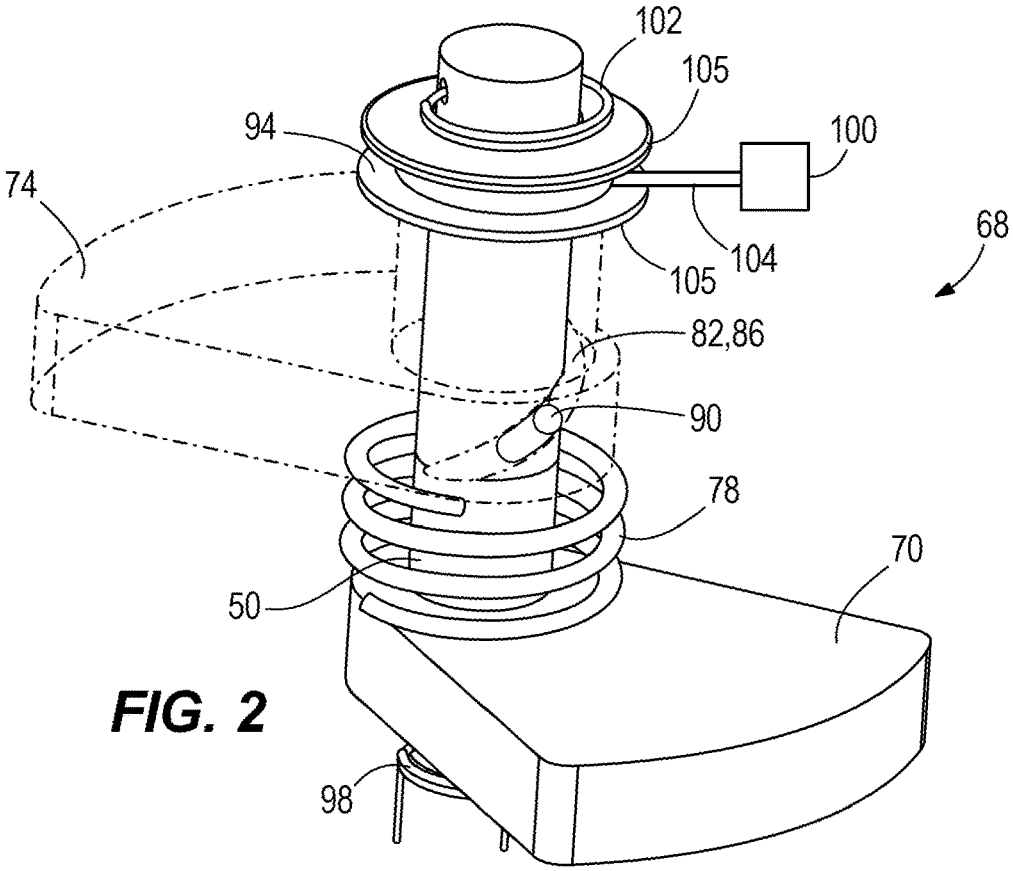
FIG. 2 is a perspective view of an exciter assembly for use with the vibrating screed of FIG. 1, with a second eccentric mass in a first position.
Figure 4:
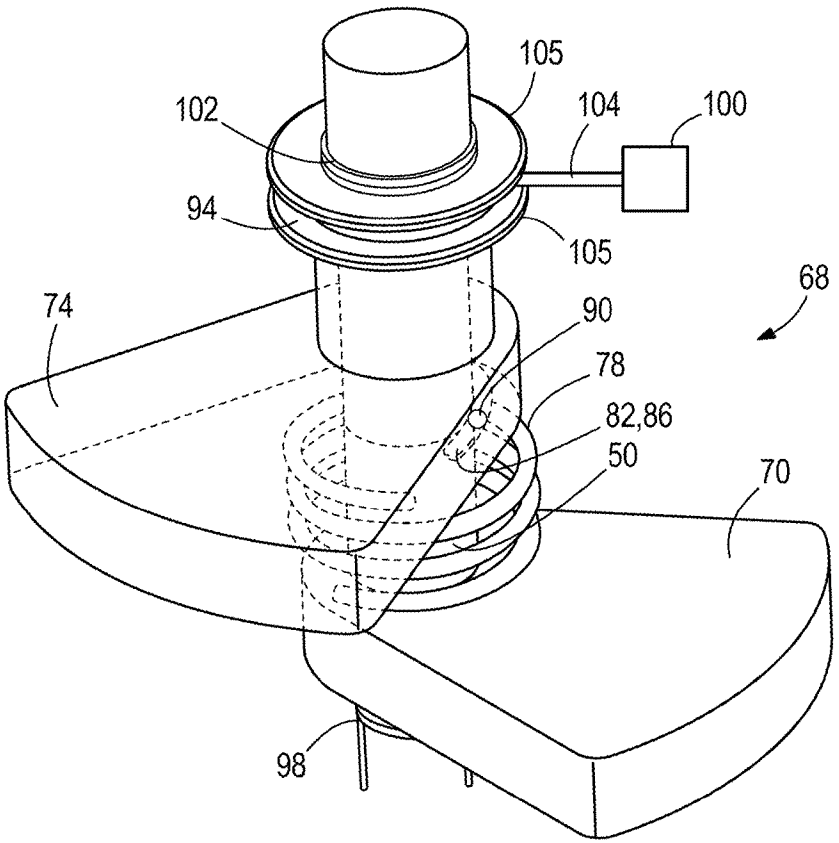
FIG. 4 is a perspective view of the exciter assembly of FIG. 2, with a second eccentric mass in a second position.
Figure 3:
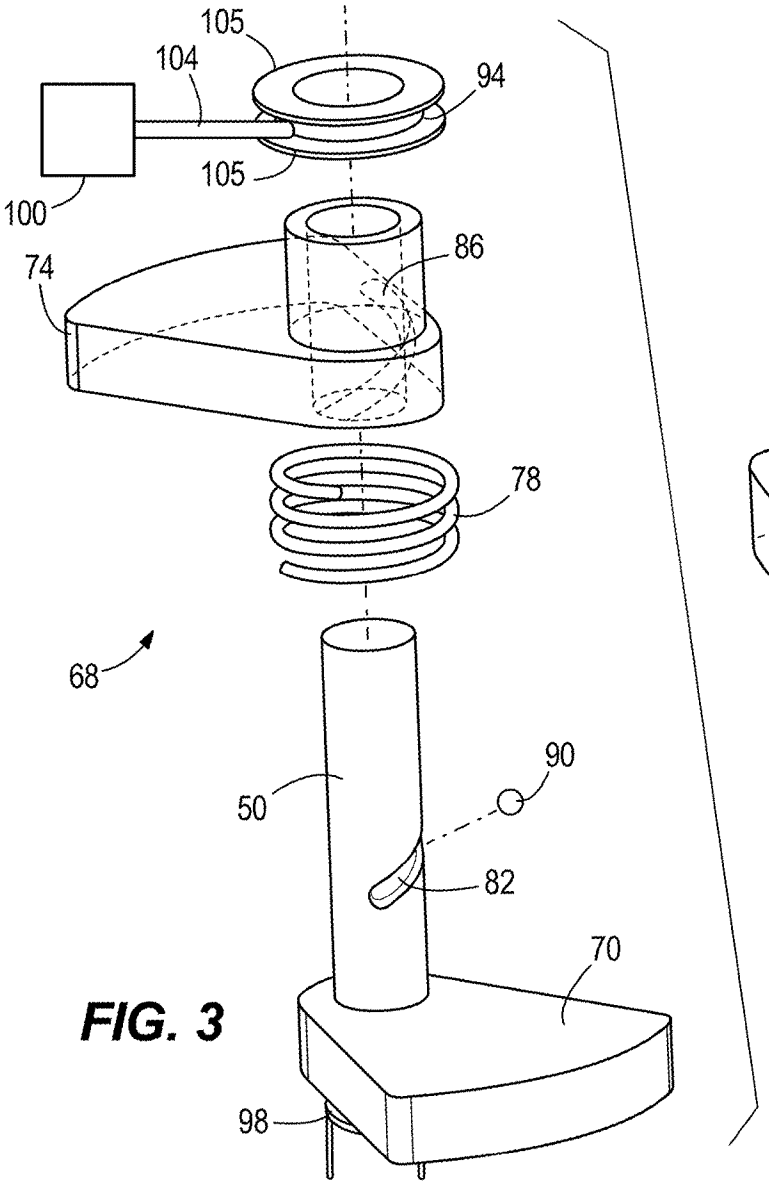
FIG. 3 is an exploded view of the exciter assembly of FIG. 2.

As shown in FIGS. 2-4, an embodiment of an exciter assembly 68 is shown that may be used with the vibrating screed 10 and arranged within the exciter housing 62, instead of the exciter assembly 54. The exciter assembly 68 includes a first eccentric mass 70 that is fixed on the driveshaft 50 and a second eccentric mass 74 that is moveable along the driveshaft 50, as described in further detail below. A spring 78 is arranged on the driveshaft 50 and seated on the first eccentric mass 70 to bias the second eccentric mass 74 away from the first eccentric mass 70. The driveshaft 50 includes an exterior helical groove 82, the second eccentric mass 74 includes an internal helical groove 86, and a ball 90 is arranged within and between the exterior and internal helical grooves 82, 86. A shift collar 94 is arranged on the driveshaft 50 adjacent the second eccentric mass 74 on a side of the second eccentric mass 74 opposite the first eccentric mass 70. A first bearing 98 rotatably supports the driveshaft 50 beneath the first eccentric mass 74 and a second bearing 102 rotatably supports the driveshaft 50 above the shift collar 94.

In operation of the exciter assembly 68 of FIGS. 2-4, the exciter assembly 68, in its default state, is in a first, low vibration mode shown in FIG. 2. In the low vibration mode of the exciter assembly 68, the spring 78 biases the second eccentric mass 74 upward against the shift collar 94 to a first position in which the second eccentric mass 74 is oriented 180 degrees about the driveshaft 50 from the first eccentric mass 70. Specifically, the angular position of the second eccentric mass 74 about the driveshaft 50 is dictated by the position of the ball 90 in the internal helical groove 86. When the motor 18 is activated while the exciter assembly 68 is in the first, low vibration mode, the first and second eccentric masses 70, 74 rotate with the driveshaft 50, creating vibration that is transferred through the exciter housing 62 to the screed member 14. However, because the first and second eccentric masses 70, 74 are 180 degrees from one another about the driveshaft 50, the first and second eccentric masses 70, 74 act as counterweights to one another, thus reducing the rotating unbalance of the driveshaft 50, and thus the amplitude of vibration created by the exciter assembly 68.

If the operator desires to increase the magnitude of vibration transferred to the screed member 14, the operator manipulates a mode selector 100, such as a knob or sliding actuator, on the exterior of the exciter housing 62. The mode selector 100 is operably coupled to the shift collar 94 via a shift pin 104 arranged between parallel flanges 105 of the shift collar 94. Manipulation of the mode selector 100 causes the shift collar 94, and thus the second eccentric mass 74, to move towards the first eccentric mass 70 along the driveshaft 50 to a second position (FIG. 4), corresponding to a second, high vibration mode of the exciter assembly 68. As the second eccentric mass 74 moves toward the driveshaft 50, the second eccentric mass 74 also rotates about the driveshaft 50, due to its angular position being dictated by the position of the ball 90 in the internal helical groove 86. Then, when the motor 18 is activated, because the second eccentric mass 74 is closer to being rotationally aligned, or is substantially rotationally aligned, with the first eccentric mass 70 on the driveshaft 50, the rotating unbalance of the driveshaft 50 increases, thus increasing the magnitude of vibration created by the exciter assembly 68 relative to the first, low vibration mode of the exciter assembly 68.

If the operator thereafter wants to adjust the exciter assembly 68 back to the first, low vibration mode, the operator manipulates the mode selector 100, shifting the shift collar 94 away from the first eccentric mass 70, thus allowing the spring 78 to bias the second eccentric mass 74 back to the first position shown in FIG. 2 corresponding to the first, low vibration mode of the exciter assembly 68. In some embodiments, the shift collar 94 is moveable by the mode selector 100 while the motor 18 is activated, and in other embodiments, the shift collar 94 is only moveable prior to operation, then locked in position prior to activation of the motor 18.

Figure 5:
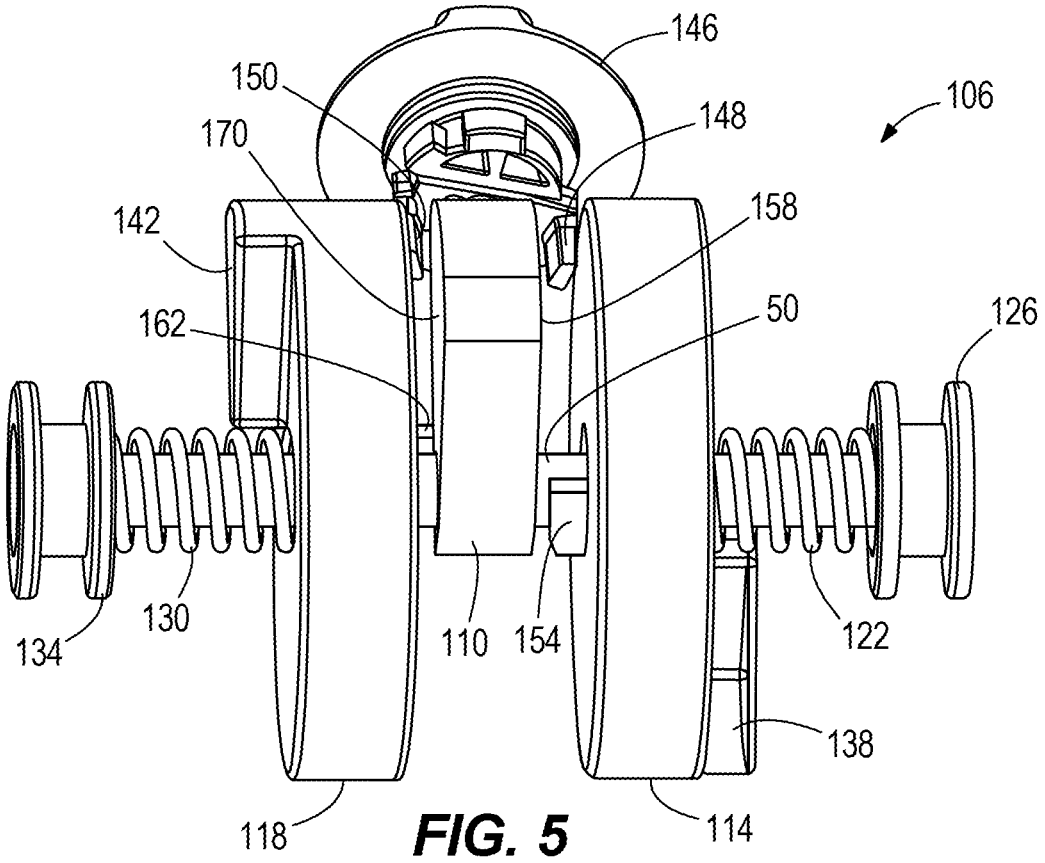
FIG. 5 is a perspective view of another exciter assembly for use with the vibrating screed of FIG. 1, with the exciter assembly in a second, medium vibration mode.
Figure 6:
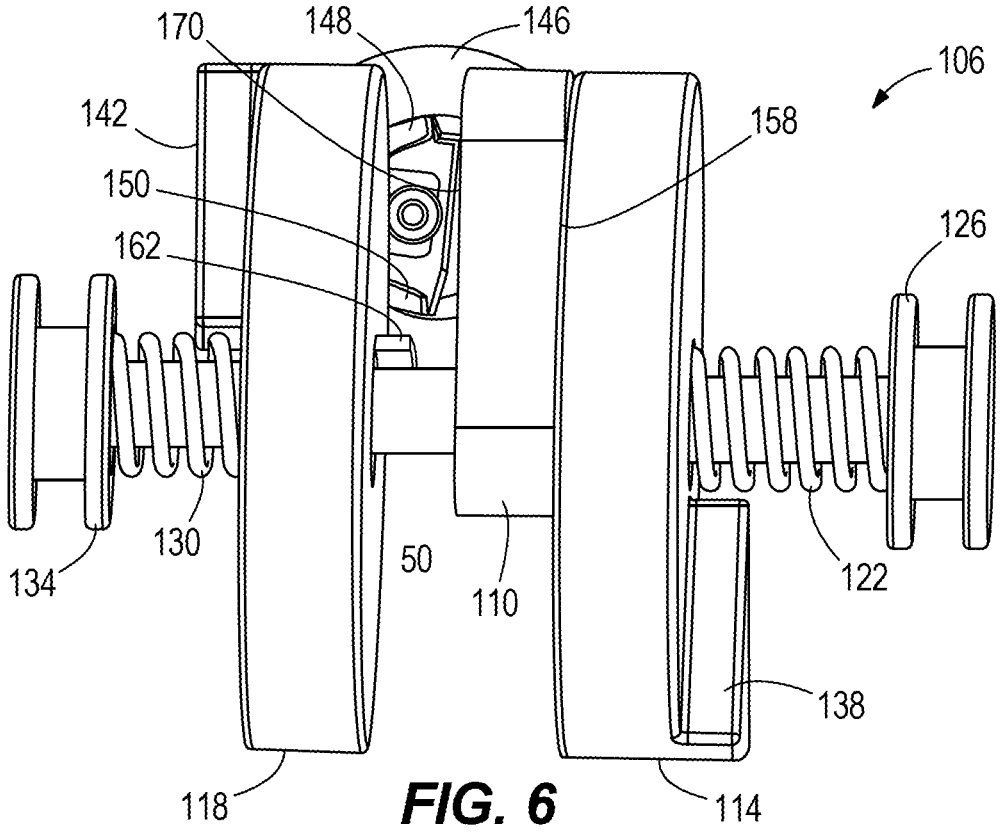
FIG. 6 is a perspective view of the exciter assembly of FIG. 5, with the exciter assembly in a first, low vibration mode.
Figure 7:
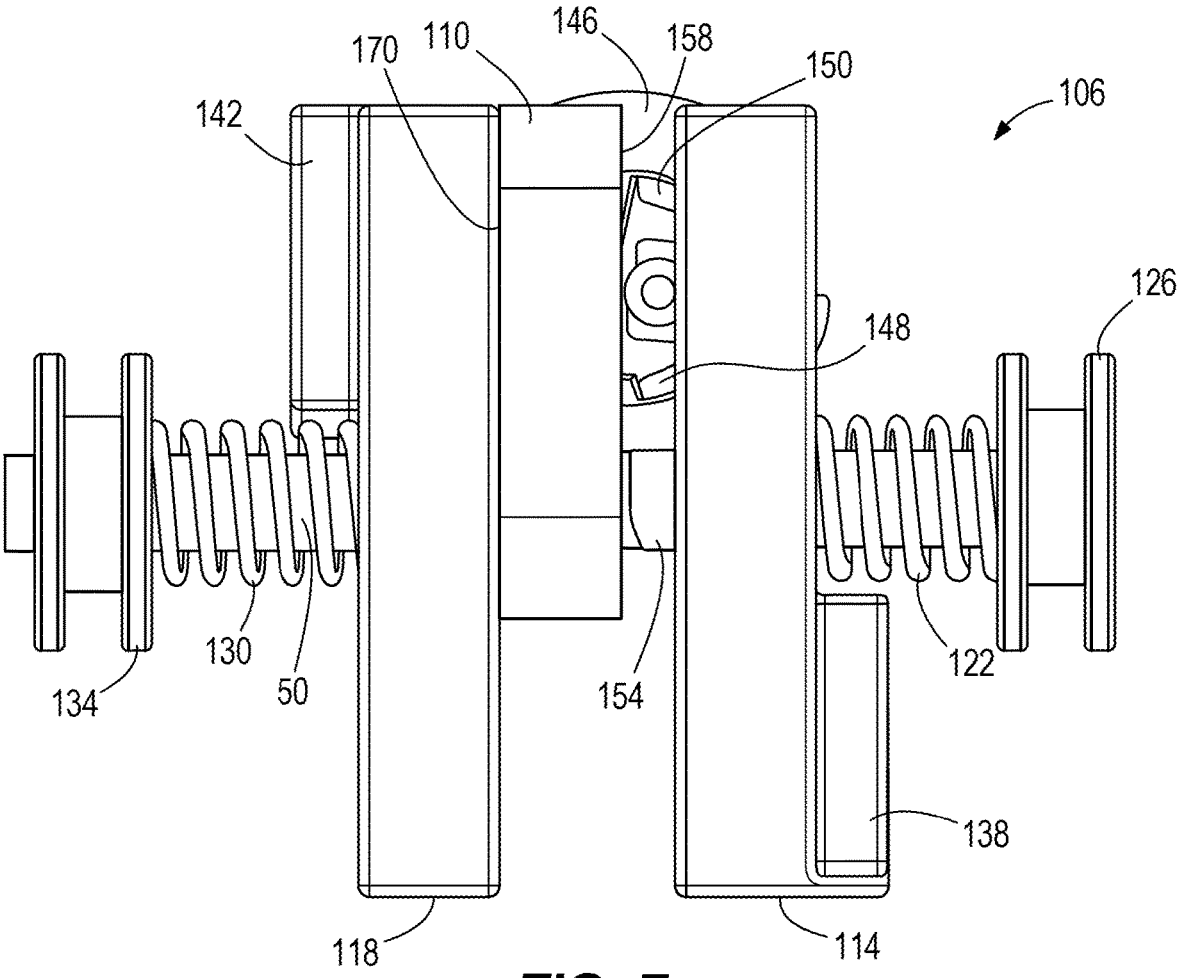
FIG. 7 is a perspective view of the exciter assembly of FIG. 5, with the exciter assembly in a third, high vibration mode.

As shown in FIGS. 5-7, another embodiment of an exciter assembly 106 is shown for use with the vibrating screed 10 and arranged within the exciter housing 62, instead of the exciter assembly 54 or the exciter assembly 68. The exciter assembly 106 includes a first eccentric mass 110 that is fixed on the driveshaft 50, a second eccentric mass 114 that is neither axially nor rotationally fixed to the driveshaft 50, and a third eccentric mass 118 that is also neither axially nor rotationally fixed with respect to the driveshaft 50, as described in further detail below. A first spring 122 is arranged on the driveshaft 50 and seated on a first thrust collar 126 to bias the second eccentric mass 114 toward the first eccentric mass 110. A second spring 130 is arranged on the driveshaft 50 and seated on a second thrust collar 134 to bias the third eccentric mass 118 toward the first eccentric mass 110.

The second eccentric mass 114 includes an eccentric weight portion 138 and the third eccentric mass 118 also includes an eccentric weight portion 142. A mode selector, such as knob 146 on the exterior of the exciter housing 62, includes a first arm 148 and a second arm 150 that are engageable, respectively or simultaneously, with the second and third eccentric masses 114, 118, as explained in further detail below.

Figure 8:
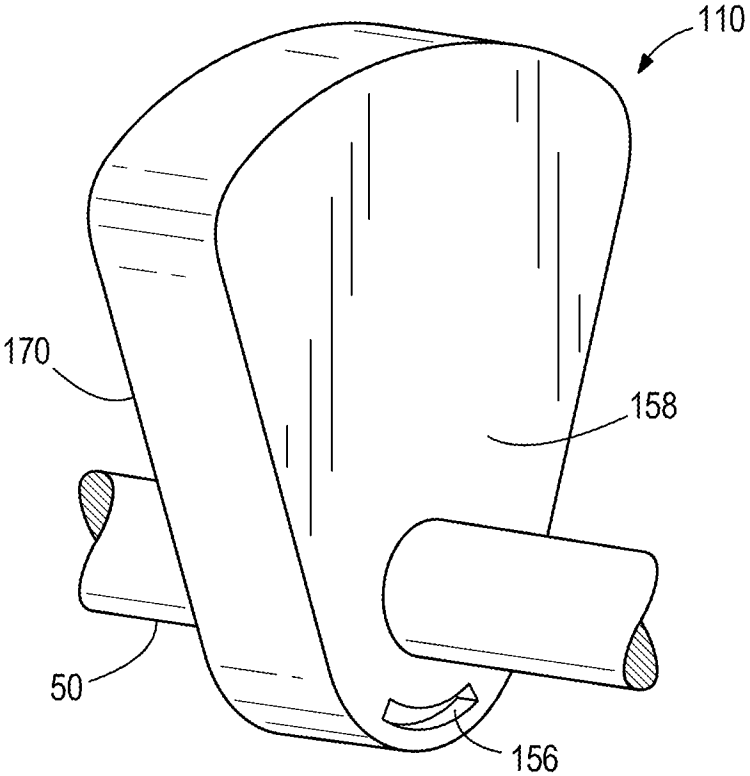
FIG. 8 is a perspective view of a first side of a first eccentric mass of the exciter assembly of FIG. 5.

As shown in FIGS. 5 and 8, the second eccentric mass 114 includes a clutch member 154 that is configured to be received in a first recess 156 on a first face 158 of the first eccentric mass 110 that is in facing relationship with the second eccentric mass 114. The first recess 156 is rotationally positioned on the first face 158 and the clutch member 154 is rotationally positioned on the second eccentric mass 114 such that when the clutch member 154 is received in the first recess 156, the second eccentric mass 114 becomes locked for rotation with the first eccentric mass 110 with the driveshaft 50, and the eccentric weight portion 138 of the second eccentric mass 114 is arranged 180 degrees about the driveshaft 50 from the first eccentric mass 110.

Figure 9:
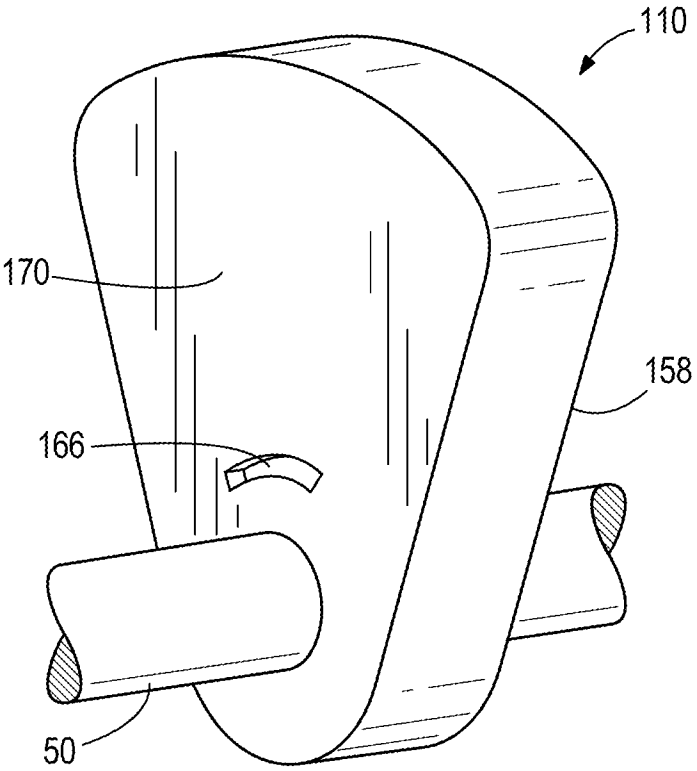
FIG. 9 is a perspective view of a second side of a first eccentric mass of the exciter assembly of FIG. 5.

As shown in FIGS. 5 and 9, the third eccentric mass 118 includes a clutch member 162 that is configured to be received in a second recess 166 on a second face 170 of the first eccentric mass 110 that is in facing relationship with the third eccentric mass 118. The second face 170 of the first eccentric mass 110 is opposite the first face 158. The second recess 166 is rotationally positioned on the second face 170 and the clutch member 162 is rotationally positioned on the third eccentric mass 118, such that when the clutch member 162 is received in the second recess 166, the third eccentric mass 118 becomes locked for rotation with the first eccentric mass 110 with the driveshaft 50, and the eccentric weight portion 142 of the third eccentric mass 118 is rotationally aligned with the first eccentric mass 110 on the driveshaft 50.

In operation of the exciter assembly 106 of FIGS. 5-7, the knob 146 is moveable to a first position (FIG. 6), in which the knob 146 is rotated such that both of the first and second arms 148, 150 only engage the third eccentric mass 118, thus putting the exciter assembly 106 in a first, low vibration mode. Because neither of the first and second arms 148, 150 block the second eccentric mass 114, it is biased toward the first eccentric mass 110 by the first spring 122, such that when the clutch member 154 is received in the first recess 156, the second eccentric mass 114 becomes locked for rotation with the first eccentric mass 110 with the driveshaft 50, and the eccentric weight portion 138 of the second eccentric mass 114 is arranged 180 degrees about the driveshaft 50 from the first eccentric mass 110, as shown in FIG. 6. Thus, when the exciter assembly 106 is operated in the first, low vibration mode, because the second eccentric mass 114 is locked for rotation with the first eccentric mass 110 on the driveshaft 50, and because the eccentric weight portion of the second eccentric mass 114 is rotationally offset by 180 degrees from the first eccentric mass 110, the first and second eccentric masses 110, 114 act as counterweights to one another as they rotate together about the driveshaft 50, thus reducing the rotating unbalance of the driveshaft 50, and thus the magnitude of vibration of the exciter assembly 106. As co-rotation of the first and second eccentric masses 110, 114 occurs, the third eccentric mass 118 does not rotate with the driveshaft 50 because it is blocked from mating with the first eccentric mass 110 by the arms 148, 150. Therefore, the third eccentric mass 118 remains stationary while the driveshaft 50 and the first and second eccentric masses 110, 114 co-rotate.

If the operator desires to increase vibration of the exciter assembly 106, the knob 146 is moveable to a second position (FIG. 5), in which the knob 146 is rotated such that the first arm 148 engages the second eccentric mass 114, and the second arm 150 engages the third eccentric mass 118, thus putting the exciter assembly 106 in a second, medium vibration mode. In the second, medium vibration mode, the second and third eccentric masses 114, 118 are respectively blocked by the first and second arms 148, 150 from axially mating against the first eccentric mass 110, such that neither of the first and second eccentric masses 114, 118 is mated for rotation with the first eccentric mass 110 or the driveshaft 50. Thus, when the exciter assembly 106 is operated in the second, medium vibration mode, because the first eccentric mass 110 is not rotationally mated with the second eccentric mass 114, neither the second nor the third eccentric masses 114, 118 are able to act as counterweights to one another (as in the first, low vibration mode). As such, the rotating unbalance of the driveshaft 50 and a magnitude of vibration of the exciter assembly 106 is increased relative to the first, low vibration mode.

If the operator desires to further increase vibration of the exciter assembly 106, the knob 146 is moveable to a third position (FIG. 7), in which the knob 146 is rotated such that both of the first and second arms 148, 150 only engage the second eccentric mass 114, thus putting the exciter assembly 106 in a third, high vibration mode. Because neither of the first and second arms 148, 150 block the third eccentric mass 118, the third eccentric mass 118 is biased toward the first eccentric mass 110 by the second spring 130, such that when the clutch member 162 is received in the second recess 166, the third eccentric mass 118 becomes locked for rotation with the first eccentric mass 110 on the driveshaft 50, and the eccentric weight portion 142 of the third eccentric mass 118 is rotationally aligned with the first eccentric mass 110 on the driveshaft 50, as shown in FIG. 6. Thus, when the exciter assembly 106 is operated in the third, high vibration mode, because the third eccentric mass 118 is locked for rotation with the first eccentric mass 110 on the driveshaft 50, and because the eccentric weight portion 142 of the third eccentric mass 118 is rotationally aligned with the first eccentric mass 110, the unbalance on the driveshaft 50 is increased as compared to when the third eccentric mass 118 is spaced from and not rotatable with the first eccentric mass 110. Thus, the rotating unbalance of the driveshaft 50 and the magnitude of vibration of the exciter assembly 106 is increased relative to the first and second modes. As co-rotation of the first and third eccentric masses 110, 118 occurs, the second eccentric mass 114 does not rotate with the driveshaft 50 because it is blocked from mating with the first eccentric mas 110 by the arms 148, 150. Therefore, the second eccentric mass 114 remains stationary while the driveshaft 50 and masses 110, 118 co-rotate.

Typical vibrating screeds limit or do not give the operator the ability to adjust the magnitude of vibration that is delivered to the screed member 14, independent of adjusting the speed of the motor 18 (and thus the frequency, but not magnitude, of vibration). Even if the operator can change the magnitude of vibration on typical vibrating screeds, such magnitude changes involve manually removing a nut or bolt from the driveshaft to adjust the position of the eccentric mass to a desired position, which is time consuming, difficult, and can undesirably expose the exciter assembly to concrete.

In contrast to typical vibrating screeds, the exciter assemblies 68, 106 are both arranged in the sealed exciter housing 62, and changing the magnitude of vibration delivered to the screed member 14 is as simple as adjusting the mode selection members 146. This allows the operator to quickly and efficiently change vibration modes for new pour conditions in a screed operation, while simultaneously providing better protection to the exciter assemblies 68, 106, thus increasing their longevity.

Figure 10:
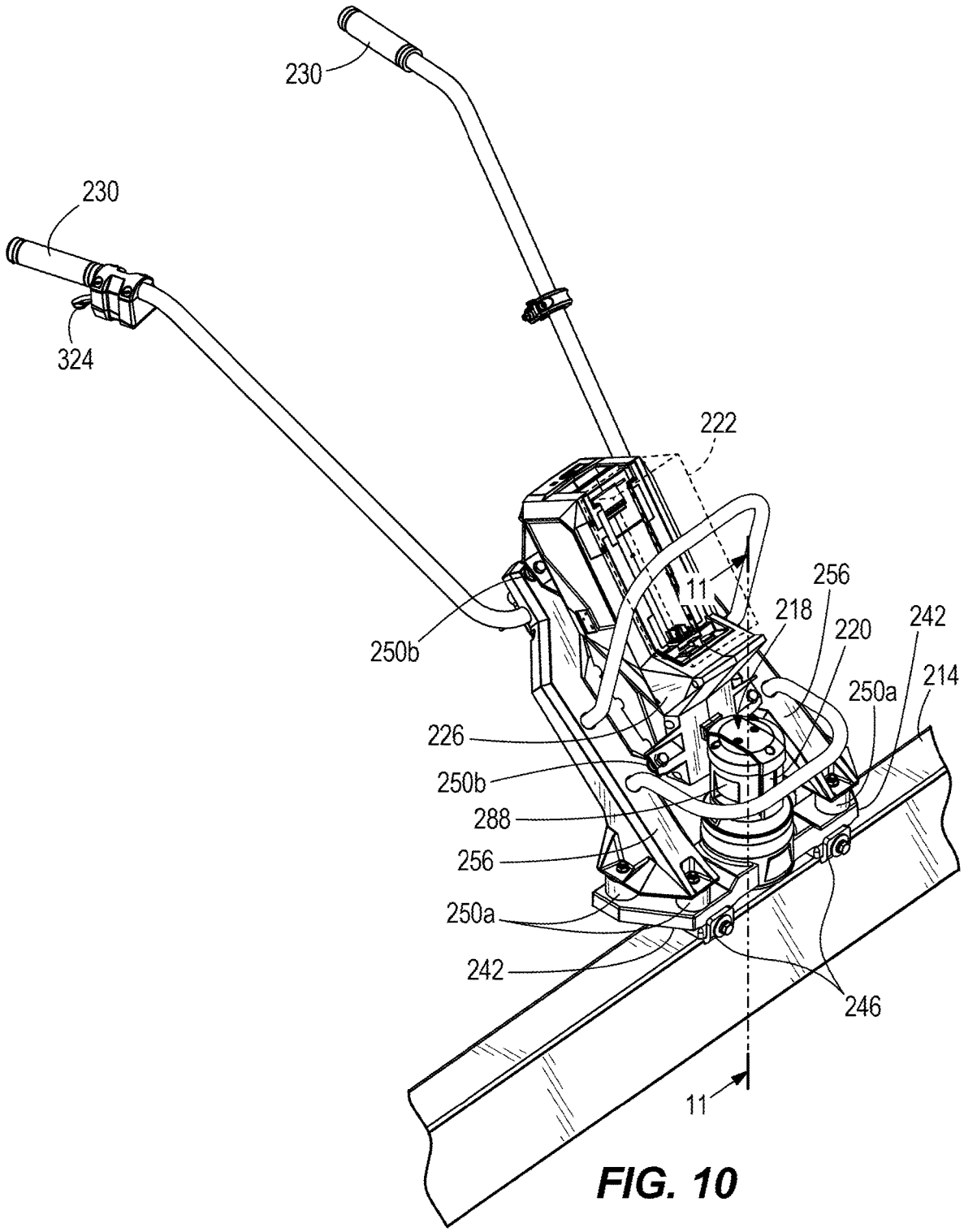
FIG. 10 is a perspective view of a vibrating screed according to another embodiment.
Figure 11:
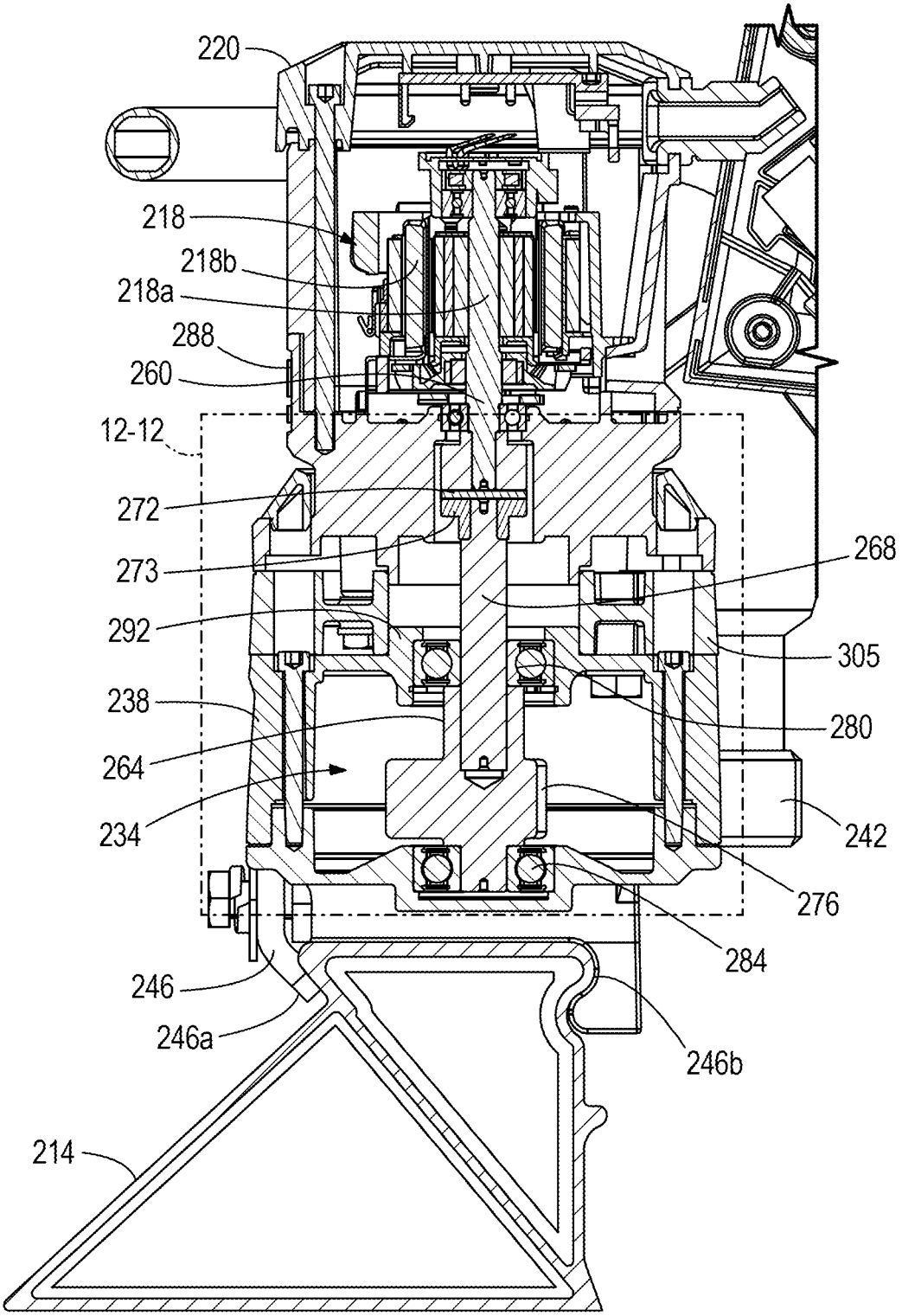
Figure 12:
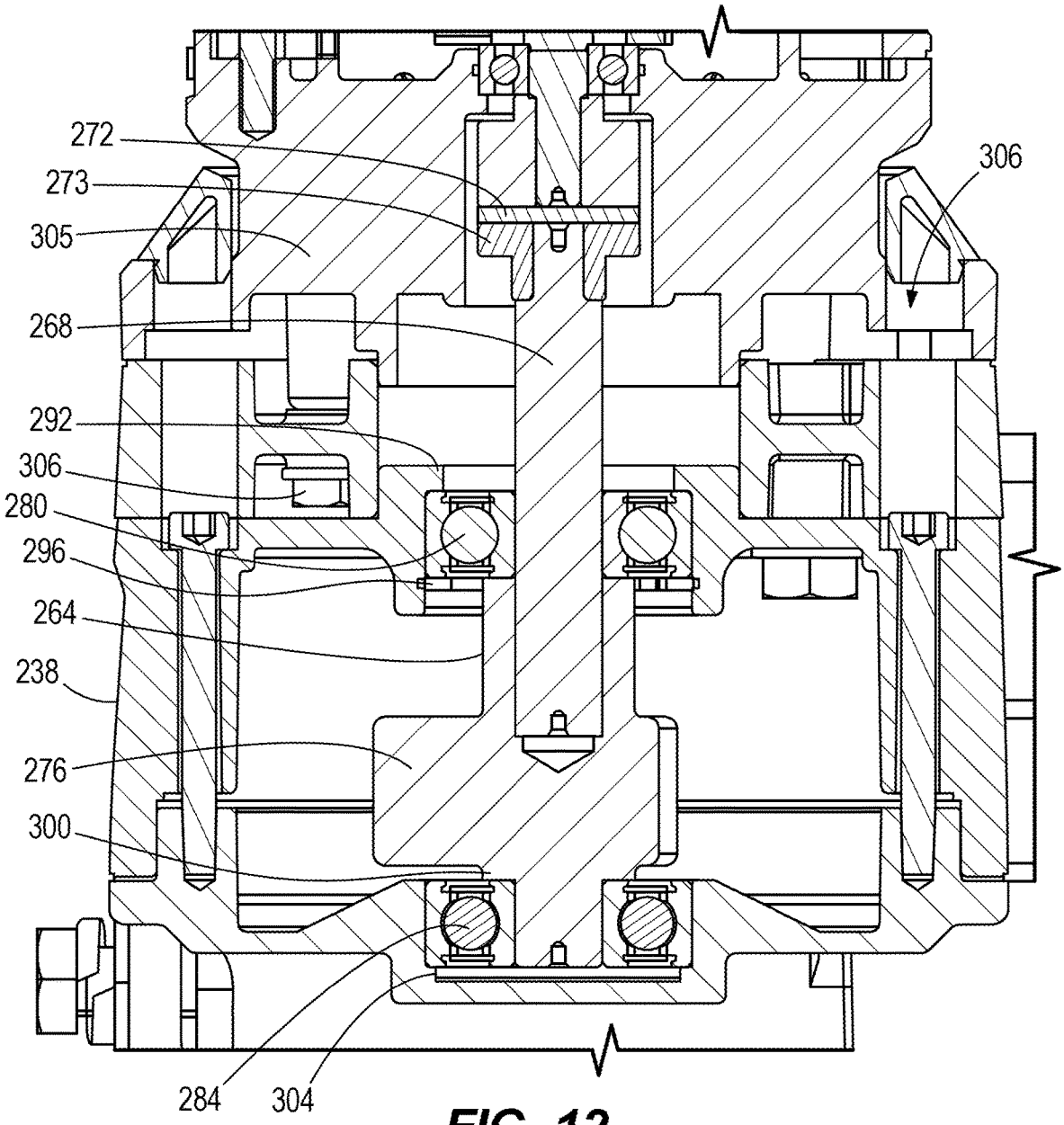
FIG. 12 is an enlarged cross-sectional view of the vibrating screed taken along line 12-12 in FIG. 11.

FIGS. 10-12 illustrate a vibrating screed 210 according to another embodiment. The vibrating screed 210 may include features similar to the vibrating screed 10 discussed above. Conversely, features of the vibrating screed 210 may apply to the vibrating screed 10 discussed above. As shown in FIG. 10, the vibrating screed 210 includes a screed blade 214 for smoothing and leveling a viscous material, such as concrete. The vibrating screed 210 also includes a brushless DC (BLDC) electric motor 218 within a motor housing 220, a battery pack 222 for powering the motor 218, and a housing 226 within which control electronics associated with the motor 218 (e.g., one or more of the electronic processor 308, memory 312, power switching network 316, and/or memory 328) are located and upon which the battery pack 222 is supported. The motor 218 includes a rotor **218*a* and a stator 218*b* (FIG. 11). The screed 210 also includes a pair of handles 230 (FIG. 10) extending from a frame 256 that are grasped by a user for maneuvering the screed 210** around a work site.

The motor 218 is configured to drive an exciter assembly 234 including an exciter housing 238 (FIG. 11). The exciter housing 238 includes a pair of wings 242 (FIG. 10) extending parallel with the screed blade 214. Each wing 242 includes a clamp 246 (FIG. 11) fastened thereto to clamp onto the screed blade 214 and secure the screed blade 214 to the exciter housing 238. In some embodiments, the clamp 246 may be configured as a quick release mechanism including, for example, an over-center cam latch. As illustrated in FIG. 11, each of the clamps 246 includes an edge clamp **246*a*, which is fastened to an associated wing 242, and a compatible interface 246*b*, which is integrally formed with the associated wing 242 of the exciter housing 238. The interface 246*b* is shaped to be compatible with various screed blades 214. The clamp 246 may be another mechanism operable to secure the screed blade 214 to the wing 242**.

Figure 10A:
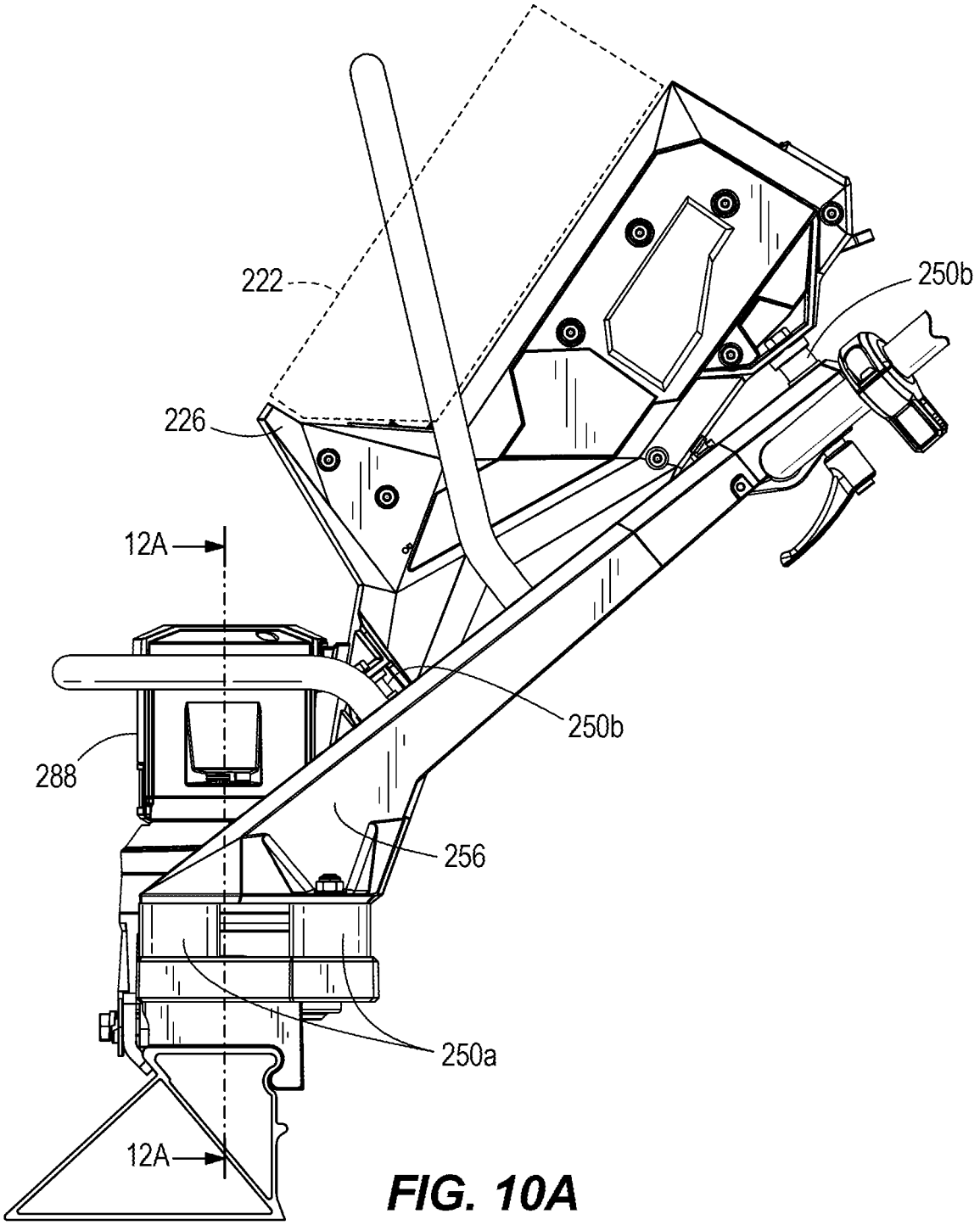
FIG. 10A is a side view of the vibrating screed of FIG. 10.

As shown in FIGS. 10 and 10A, to attenuate vibration transmitted to the operator, the control electronics within the housing 226, and the battery pack 222, vibration dampers **250*a* (e.g., visco-elastic bushings or a spring-damper unit) are arranged between each of the wings 242 and the frame 256. Additionally, vibration dampers 250*b* (e.g., visco-elastic bushings or a spring-damper unit) are arranged between the frame 256 and the housing 226. In the illustrated embodiment of the vibrating screed 210, four vibration dampers 250*a* are cylindrically shaped and are provided in a rectangular array (as viewed from above) between the frame 256 and the exciter housing 238. And, in the illustrated embodiment of the vibrating screed 210, four vibration dampers 250*b* are cylindrically shaped and are provided in a rectangular array (as viewed in a direction perpendicular to the frame 256) between the frame 256 and the housing 226. The vibration dampers 250*a*, 250*b* are also symmetrically located relative to a vertical plane (co-planar with section 11-11 in FIG. 10) bisecting the housing 226 and the motor 218**.

As shown in FIG. 11, a driveshaft 260 receives torque from the motor 218 and transmits the torque to an exciter shaft 264 of the exciter assembly 234 via an intermediate shaft 268 and an elastomeric coupler 272. The exciter shaft 264 includes an eccentric mass 276 and is rotatably supported within the exciter housing 238 by first and second bearings 280, 284. A motor cap 288 is arranged on the motor housing 220 and covers the driveshaft 260 by extending over a neck 292 of the exciter housing 238. In response to the motor 218 rotating the driveshaft 260, the eccentric mass 276 rotates, causing a rotating imbalance that transmits vibration through the exciter housing 238 to the screed blade 214, thus causing the screed blade 214 to vibrate in a direction perpendicular to the exciter shaft 264.

Figure 12A:
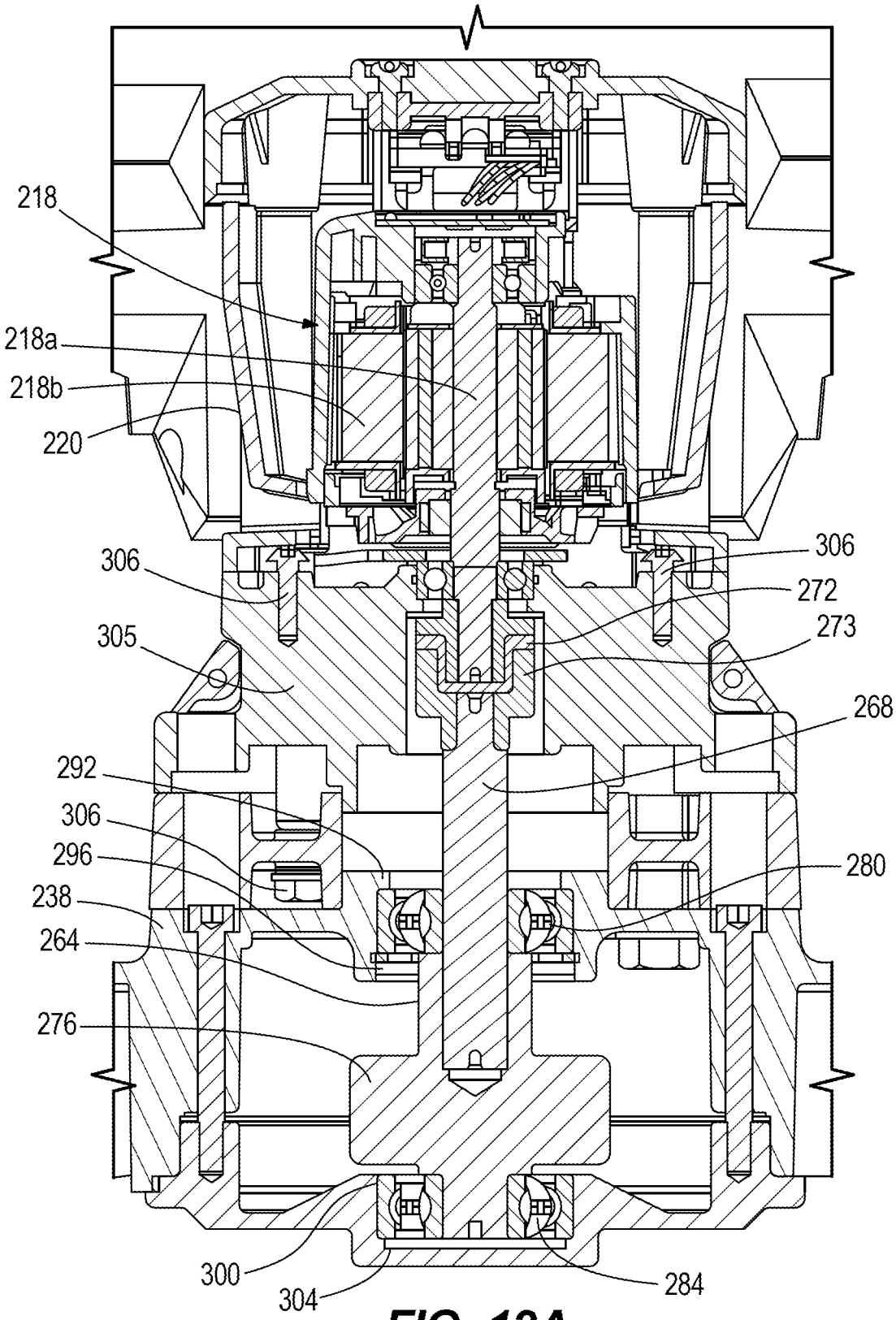
FIG. 12A is a cross-sectional view of the vibrating screed taken along line 12A-12A in FIG. 10A.

As shown in FIG. 12, the first bearing 280 is arranged between the neck 292 of the exciter housing 238 and a retaining ring 296 set in the exciter housing 238. The second bearing 284 is arranged between larger diameter portion 300 of the exciter shaft 264, and a lower ledge 304 of the exciter housing 238. As shown in FIG. 12A, both exciter housing 238 and the motor housing 220 are fixedly secured to an intermediate housing 305 by a number of fasteners 306. At least one fastener 306 secures the exciter housing 238 to the intermediate housing 305. At least one fastener 306 secures the motor housing 220 to the intermediate housing 305. And, the exciter housing 238 is rigidly connected to the wings 242 which, in turn, are rigidly connected to the screed blade 214 via the clamps 246. As such, vibration created by the rotating eccentric mass 276 is transmitted through the exciter housing 238 and the wings 242 without attenuation. The elastomeric coupler 272 is located within the intermediate housing 305. In the illustrated embodiment, the elastomeric coupler 272 is formed of plastic. The elastomeric coupler 272 provides inline isolation of vibration generated by the eccentric mass 276 to inhibit damage to the motor 218. The illustrated elastomeric coupler 272 engages a secondary coupler 273 and the rotor 218*a*. The secondary coupler 273 engages the elastomeric coupler 272 and the intermediate shaft 268.

Figure 13:
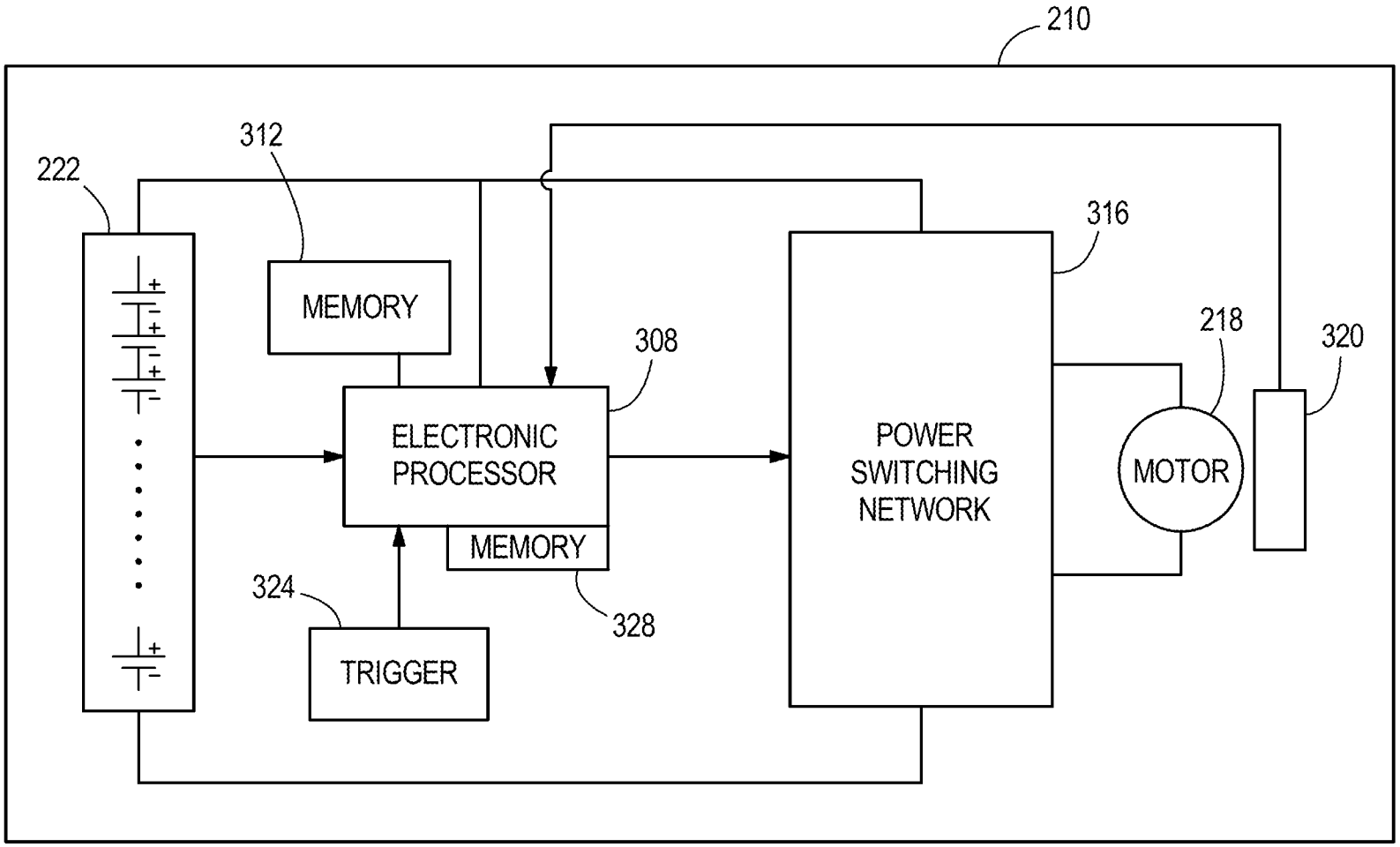
FIG. 13 is a simplified block diagram of the vibrating screed of FIG. 10.

FIG. 13 is a simplified block diagram of the vibrating screed 210 according to one example embodiment. In the example illustrated, the vibrating screed 210 includes an electronic processor 308, a memory 312, the battery pack 222, a power switching network 316 (including field-effect transistors or FETs), a rotor position sensor 320, and the trigger 324 (see FIG. 10 which illustrates the trigger 324 adjacent one of the handles 230). In some embodiments, the electronic processor 308 is implemented as a microprocessor with a separate memory (for example, memory 312). In other embodiments, the electronic processor 308 may be implemented as a microcontroller (with memory 328 on the same chip). In other embodiments, the electronic processor 308 may be implemented using multiple processors. In addition, the electronic processor 308 may be implemented partially or entirely as, for example, a field programmable gate array (FPGA), an application specific integrated circuit (ASIC), etc., and the memory 312 may not be needed or may be modified accordingly. The memory 312 stores instructions executed by the electronic processor 308 to carry out functions of the vibrating screed 210 described herein. The memory 312 includes read only memory (ROM), random access memory (RAM), other non-transitory computer-readable media, or a combination thereof.

The power switching network 316 enables the electronic processor 308 to control the operation of the motor 218. Generally, when the trigger 324 is depressed, electrical current is supplied from the battery pack 222 to the motor 218, via the power switching network 316. When the trigger 324 is not depressed, electrical current is not supplied from the battery pack 222 to the motor 218. In some embodiments, the amount in which the trigger 324 is depressed is related to or corresponds to a desired speed of rotation of the motor 218 (that is, closed loop speed control). In other embodiments, the amount in which the trigger 324 is depressed is related to or corresponds to a desired torque (that is, open loop speed control, or "direct drive").

In response to the electronic processor 308 receiving a drive request signal from the trigger 324, the electronic processor 308 activates the power switching network 316 to provide power to the motor 218. Through the power switching network 316, the electronic processor 308 controls the amount of current available to the motor 218 and thereby controls the speed and torque output of the motor 218. The power switching network 316 includes a plurality of FETs, for example, a six-FET bridge that receives pulse-width modulated (PWM) signals from the electronic processor 308.

The rotor position sensor 320 is coupled to the electronic processor 308. The rotor position sensor 320 includes, for example, a plurality of Hall-effect sensors, a quadrature encoder, or the like attached to the motor 18. The rotor position sensor 320 outputs motor feedback information to the electronic processor 308, such as an indication (e.g., a pulse) when a magnet of a rotor of the motor 218 rotates across the face of a Hall sensor. Based on the motor feedback information from the rotor position sensor 320, the electronic processor 308 can determine the position, velocity, and acceleration of the rotor 218*a*. In response to the motor feedback information and the signals from the trigger 324, the electronic processor 308 transmits control signals to control the power switching network 316 to drive the motor 18. For instance, by selectively enabling and disabling the FETs of the power switching network 316, power received from the battery pack 222 is selectively applied to the stator windings of the motor 218 in a cyclic manner to cause rotation of the rotor of the motor 18.

In some embodiments, the motor 218 is a sensorless motor that does not include the Hall-effect sensors. Removing the Hall-effect sensors provides the advantage of further reducing the size of the motor package. In these embodiments, the rotor position is detected based on the detecting the current, back electro-motive force (EMF), and/or the like in the inactive phases of the motor 218. Specifically, rather than the Hall sensors, current sensors, voltage sensors, or the like are provided outside the motor 18, for example, in the power switching network 316 or on a current path between the power switching network 316 and the motor 218. The permanent magnets of the rotor 218*a* generate a back EMF in the inactive phases as the rotor 218*a* moves past the stator phase coils. The electronic processor 308 detects the back EMF (e.g., using a voltage sensor) or the corresponding current (e.g., using a current sensor) generated in the inactive phase to determine the position of the rotor 218*a*. The motor 218 is then commutated similarly as described above based on the position information of the rotor 218*a*. Such a sensorless motor 218 may function without hall sensors acting as a quadrature encoder to output motor speed. Alternatively, constant power control circuitry may be used to minimize the impact in speed as the battery 222 state of charge diminishes. Such a sensorless motor 218 may include an initialization rotor alignment routine which is performed when starting the rotor 218*a* to determine the position of the rotor 218*a* before commutating.

The motor feedback information is used by the electronic processor 308 to ensure proper timing of control signals to the power switching network 316 and to provide closed-loop feedback to control the speed of the motor 218 to be at a desired level (i.e., at a constant speed). Specifically, the electronic processor 308 increases and decreases the duty ratio of the PWM signals provided to the power switching network 316 to maintain the speed of the motor 218 at a speed selected by the trigger 324. For example, as the load on the motor 218 increases, the speed of the motor 218 may decrease. The electronic processor 308 detects the decrease in speed using the rotor position sensor 320 or the back EMF sensors and proportionally increases the duty ratio of the PWM signals provided to the power switching network 316 (and thereby, the electrical power provided to the motor 218) to increase the speed back up to the selected speed. Similarly, when the load on the motor 218 decreases, the speed of the motor 218 may increase. The electronic processor 308 detects the increase in speed using the rotor position sensor 320 or the back EMF sensors and proportionally decreases the duty ratio of the PWM signals provided to the power switching network 316 (and thereby, the electrical power provided to the motor 218) to decrease the speed back down to the selected speed. Such operation of the electronic processor 308 may be continuous when the vibrating screed 210 is operated.

In open loop speed control, the electronic processor 308 maintains a constant duty ratio of the PWM signals (and thereby, constant electrical power provided to the motor 218) corresponding to the position of the trigger 324.

The electronic processor 308 is operable to receive the sensed position of the rotor 218*a* and to commutate the electric motor 18 according to the sensed position. Additionally or alternatively, the electronic processor 308 is operable to receive the sensed speed of the rotor 218*a* and to adjust the amount of power provided to the electric motor 218 in the manner described above such that the motor 218 is driven at a desired speed. In the illustrated embodiment, the desired speed is a speed above 9,000 revolutions per minute. For example, the desired speed may be 10,000 revolutions per minute. As the speed of the electric motor 218 is maintained at the desired speed, a vibration frequency of the screed blade 214 is also maintained.

It is desired to maintain the vibration frequency of the screed blade 214 during operation of the vibrating screed 210. While passing the screed blade along wet concrete, it is important to vibrate the screed blade 214 at a speed high enough for proper concrete consolidation. If the speed of the motor 218 drops below a threshold, for example, 9,000 revolutions per minute, the concrete may not consolidate properly. Additionally, if the speed of the motor 218 rises above a threshold, for example, 15,000 revolutions per minute, the concrete may not consolidate properly. Thus, the integrity and appearance of the vibrated concrete will be negatively affected if the vibration frequency falls outside a threshold range.

By sensing the speed of the rotor 218*a* and commutating the electric motor 218 according to the sensed speed, the motor 218 can circumvent any speed discrepancies due to changes in the state of charge of the battery pack 222. As the vibrating screed 210 is used, the battery pack 222 state of charge becomes depleted. The electronic processor 308 is operable to receive sensed speed of the rotor 218*a* from the rotor position sensor 320 or the back EMF sensors, and operate commutation of the motor 218 independent of the state of charge of the battery pack 222.

By utilizing the electronic processor 308 and rotor position sensor 320 of the BLDC motor 218, the vibrating screed 210 has numerous other advantages over other known vibrating screeds. The vibrating screed 210 is capable of operating at a higher efficiency when compared to known vibrating screeds. By commutating the motor 218 based on the sensed rotor 218*a* speed, mechanical drag and friction between components is eliminated. By commutating the motor 218 based on the sensed rotor 218*a* position, a constant phase advance can be optimized for relatively consistent loading of the tool. This is not possible with brushed DC electric motors. In brushed DC electric motors, brushes wear and the phase advance changes with the brush geometry. As such, the efficiency remains high because the brushless DC motor 218 phase advance is optimized and does not change throughout use.

Various features of the invention are set forth in the following claims.

What is claimed is:

1. A vibrating screed comprising:

a screed member;

a motor;

an exciter assembly configured to vibrate the screed member in response to receiving torque from the motor via a driveshaft;

a frame coupled to the screed via a first plurality of vibration dampers configured to attenuate a transfer of vibration from the screed member to the frame; and a housing in which control electronics for the motor are located, the housing coupled to the frame via a second plurality of vibration dampers configured to attenuate a transfer of vibration from the frame to the housing.

2. The vibrating screed of claim 1, further comprising a handle coupled to the frame.

3. The vibrating screed of claim 1, wherein the exciter assembly includes an exciter housing and a clamp configured to clamp onto the screed member and secure the screed member to the exciter housing.

4. The vibrating screed of claim 3, wherein the exciter housing includes a pair of wings extending parallel with the screed member, and wherein the first plurality of vibration dampers are positioned between the frame and each of the wings.

5. The vibrating screed of claim 1, wherein the first plurality of vibration dampers are visco-elastic bushings.

6. The vibrating screed of claim 1, wherein the second plurality of vibration dampers are visco-elastic bushings.

7. The vibrating screed of claim 1, further comprising a battery pack supported upon the housing.

8. The vibrating screed of claim 7, wherein the first and second pluralities of vibration dampers are configured to attenuate a transfer of vibration from the screed member to the battery pack.

9. The vibrating screed of claim 7, wherein the battery pack includes a nominal voltage of 80 V and is configured to output a sustained operating discharge current between 40 A and 60 A.

10. The vibrating screed of claim 9, wherein the motor is a brushless DC electric motor having a power output of at least 2760 W and a nominal outer diameter of up to 80 mm.

* * * * *